United States Patent [19]

Smith

[11] 3,993,245

[45] Nov. 23, 1976

[54] METHOD AND APPARATUS FOR SPRAYING AGROCHEMICALS

[75] Inventor: Colin P. Smith, Johannesburg, South Africa

[73] Assignee: Shell Oil Company, Houston, Tex.

[22] Filed: Feb. 3, 1976

[21] Appl. No.: 654,815

[30] Foreign Application Priority Data

Feb. 6, 1975 United Kingdom ..... 5081/75

[52] U.S. Cl. ..... 239/8; 239/309; 239/311; 239/373; 169/71; 222/399; 239/154

[51] Int. Cl.[2] ..... A62C 13/40

[58] Field of Search ..... 239/152–154, 239/309, 311, 373, 108–110; 169/71, 85, 83; 222/399, 192

[56] References Cited

UNITED STATES PATENTS

| | | | |
|---|---|---|---|
| 2,559,091 | 7/1951 | Reasenberg | 239/309 X |
| 2,630,942 | 3/1953 | Shaffer | 239/309 X |
| 2,728,495 | 12/1955 | Eaton | 222/192 |
| 2,730,093 | 1/1956 | Neely | 239/309 X |
| 3,255,824 | 6/1966 | Rodgers | 169/85 X |
| 3,352,456 | 11/1967 | Swineford | 222/399 X |

FOREIGN PATENTS OR APPLICATIONS

| | | | |
|---|---|---|---|
| 830,434 | 5/1938 | France | 169/85 |
| 904,785 | 3/1945 | France | 169/85 |
| 541,602 | 12/1941 | United Kingdom | 239/373 |
| 897,286 | 5/1962 | United Kingdom | 239/154 |

*Primary Examiner*—Robert S. Ward, Jr.

[57] ABSTRACT

A spraying apparatus is charged with pesticide, and optionally also pressurized, by the attachment and puncture of a pressurized container of agrochemical.

4 Claims, 3 Drawing Figures

METHOD AND APPARATUS FOR SPRAYING AGROCHEMICALS

BACKGROUND OF THE INVENTION

1. Field of the Invention

This invention relates to an improved method of spraying agrochemicals in admixture with water, and to apparatus suitable for use in this method.

2. Description of the Prior Art

In many types of agrochemical application it is convenient to apply the agrochemical to the area under treatment (crop, soil, etc.) by means of a water-based spray, in which a suitable formulation of the active ingredient is mixed with water and the resulting spray mixture (which may contain the active ingredient in solution, suspension or dispersion) is fed from a spray tank through one or more spray nozzles designed to distribute this mixture as a spray having the desired drop size and distribution pattern. The preparation of the spray mixture has hitherto normally been carried out by filling the spray tank with water and putting the agrochemical formulation into the water, adequate mixing of the formulation being achieved by stirring, recycling or other suitable means.

One of the drawbacks associated with this simple procedure is that the operator putting the formulation into the spray tank incurs the risk of physical contact with the active ingredient, which sometimes leads to the imposition of restrictions on the use of those agrochemicals for which such operator contact is undesirable. It has now been found, and forms the subject of this invention, that this drawback can be minimized by injecting the agrochemical formulation into the spray tank from a canister containing that formulation under pressure.

SUMMARY OF THE INVENTION

Accordingly, the present invention provides a spraying device comprising a spray tank connected through a spray valve to one or more spray nozzles, the spray tank communicating with a charging valve which incorporates means adapted to provide a substantially fluid-tight seal between a container and the charging valve, container attachment means, and container puncturing means.

In an alternative embodiment, the invention provides a method of applying an agrochemical formulation to a locus, which comprises loading water into a spray tank connected through a spray valve to one or more spray nozzles and communicating with a charging valve which incorporates puncturing means, attaching to the charging valve a container containing an agrochemical formulation under super- atmospheric pressure, puncturing the container with the puncturing means, permitting the formulation to flow from the container into the spray tank under the action of pressure whilst maintaining a substantially fluid-tight seal between the container and the charging valve, whereby the formulation is mixed with the water whilst the escape of formulation to the atmosphere is minimized or prevented, and releasing the spray valve to feed the resultant aqueous pesticide mixture from the spray tank through the spray nozzles as a spray which is distributed over the locus.

The prime functions of the charging valve are to open the pressurised container and to enable the agrochemical formulation therein to pass into the water in the spray tank. The opening of the container is achieved by the provision of a weak point in the container which can easily be penetrated by the puncturing means located in the charging valve. Conveniently this weak point is formed by sealing the container with a plug of a material sufficiently strong to retain the contents under pressure but yet capable of penetration by the puncturing means; suitable materials include rubber, plastic and soft metals such as lead. The puncturing means may consist of any sharp projection located in the charging valve so as to impinge upon the weak point in the container when the two are brought into contact. In general a convenient puncturing means is provided by a sharp needle-shaped projection, but other configurations such as a chisel shape may be utilised.

Once the container seal has been punctured it is necessary to enable its contents to pass through the charging valve and into the spray tank, and this is most simply achieved by the use of a hollow puncturing means whose hollow provides a passage communicating with the spray tank (a communication preferably closed by a non-return valve openable under the pressure released on puncture of the container seal). Additionally it is necessary to maintain the container securely attached to the charging valve during the discharge of its contents, and also to minimize any escape of the contents into the atmosphere. These functions are conveniently combined by the provision of a screw thread around the container seal which engages with a screw thread around the puncturing means. However, alternative attachment and sealing means may be used. For example, the container may be attached to the charging valve and pressed against the puncturing means by an external jacket having a screw thread which engages with a complementary screw thread on the valve. In such an embodiment, the fluid-tight seal is conveniently provided by a rubber O-ring against which the container is pressed by the external jacket.

In order to maximise utilization of the container contents it is often convenient to leave the container secured to the charging valve during the spraying operation, and since the container attachment means may not be sturdy enough to resist the physical shocks likely to be encountered in the field it is desirable for a container guard to be attached to the charging valve. Such a guard can conveniently serve the dual function of both protecting the attached container from dislodgement and also providing a guide to facilitate the accurate attachment of the container to the charging valve. Thus, when the container is of tubular configuration, the guard and guide functions can be combined by the presence around the charging valve of an open-ended sleeve having a diameter slightly greater than that of the container tube.

Once the contents of the container have entered the spray tank, their dispersion throughout the water therein can be assisted by stirring or any other suitable means. However, if the container contents enter the spray tank below the water level, it is usually found that the action of the pressure forcing these contents into the water is sufficient to produce adequate mixing. Accordingly, it is preferable for the communication between the spray tank and the charging valve to be located at or near the base of the spray tank. Satisfactory mixing of the container contents throughout the volume of the water can also be facilitated by the use of a pipe directing the contents towards the centre of the spray tank.

It therefore follows that the pressure present in the unopened container should desirably be sufficient to force its contents into the spray tank against the hydrostatic pressure caused by the water present in the tank. In certain types of spraying operation (for example, with the "Knapsack" type of sprayer) the spray mixture is forced out of the spray tank and through the spray nozzle(s) by the application of pressure in the spray tank, the pressure conveniently being generated by the action of a hand operated pressurising pump. However, when spraying according to the present invention, it is possible to generate the necessary spraying pressure from the pressurised container simply by providing an appropriate level of pressure in the container. In other types of spraying operations the spray mixture is drawn out of the spray tank and forced through the spray nozzles by the action of a motor-driven pump (for example, with most tractor or airplane distributed sprays, where the engine is used to power the pump). In such cases it is clearly unnecessary for the container to generate a substantial pressure in the spray tank, and hence the container pressure only needs to be sufficient to inject the container contents into the water in the spray tank. In either of these embodiments, the invention is well suited to the preparation and distribution of ultra-low volume sprays.

The material present in the pressurised container comprises a propellant, which is usually a normally gaseous compound liquified under pressure (such as a chlorofluoroalkane, carbon dioxide or butane), and a suitable formulation of an agrochemical. The proportion of these components will naturally be designed for particular types of application. For example, if the container is required to pressurise a Knapsack sprayer a relatively large amount of propellant will be required (such as 60 ml propellant and 2 ml agrochemical), whilst if the container is required merely to inject the formulation into a Knapsack sprayer which is independently pressurised or into a motor powered sprayer, then a much smaller volume of propellant is necessary (suitably sufficient to provide a container pressure of 5 p.s.i.g.) and the amount of agrochemical can be correspondingly increased (such as 20 ml propellant with 80 ml agrochemical). The agrochemical formulation present in the container may be any material which is conveniently applied by spraying, and may be formulated in any manner which will permit its discharge into the spray tank and rapid dispersion in the water present therein. Thus the formulation may comprise the active ingredient in the form of a liquid (either as a solution, dispersion or suspension), as a finely divided solid or as a gas, whilst the active ingredient may be a pesticide (such as an insecticide, herbicide, fungicide or nematicide) or any other agrochemical product such as a fertiliser, plant growth regulator, plant nutrient, fruit ripener, defoliant, etc. Although one of the major advantages of the spraying method of this invention is the enhanced safety to the operator, which makes it particularly suitable for the application of agrochemicals which may be toxic or dangerous in a concentrated form (such as the insecticide mevinphos), another significant advantage is the great simplicity and convenience of the apparatus which makes its use very suitable for domestic gardens. Thus a range of horticultural products may be provided in pressurised containers and applied by an unskilled domestic user simply by loading the spray tank with water and attaching the appropriate container to the charging valve.

BRIEF DESCRIPTION OF THE DRAWING

By the way of example, the invention will be explained further with reference to the accompanying schematic drawings, in which:

In FIG. 1 is shown a spray tank 1, fitted with a pressurising pump 2, operated by pump handle 3. Located at the base of spray tank 1 is an outlet port to which is secured a charging valve 4 connected to a spray hose 5, a spray valve 6 and a spray nozzle 7, and attached to the charging valve 4 is a container 8.

The charging valve 4 and the container 8 are shown in greater detail in FIGS. 2 and 3 respectively. Valve 4 comprises a housing 9, threaded at one end for attachment to the outlet port of spray tank 1 and at the other end for attachment to spray hose 5. Within housing 9 is a passage 10, providing a communication between spray tank 1 and spray hose 5, and at the side of passage 10 is an orifice, closed by a non-return valve 11, extending into the hollow of a hollow needle 12 and terminating in hole 13. Surrounding needle 12 is a cylindrical extension 14 of housing 9 having a screw thread 15 formed in its inner surface, and attached to extension 14 is an open-ended cylindrical container guide/guard 16. Referring to FIG. 3., container 8 is sealed at one end with a penetrable seal 17, around which is formed a screw thread 18 adapted to mate with the screw thread 15 of valve housing extension 14.

Figure 1:
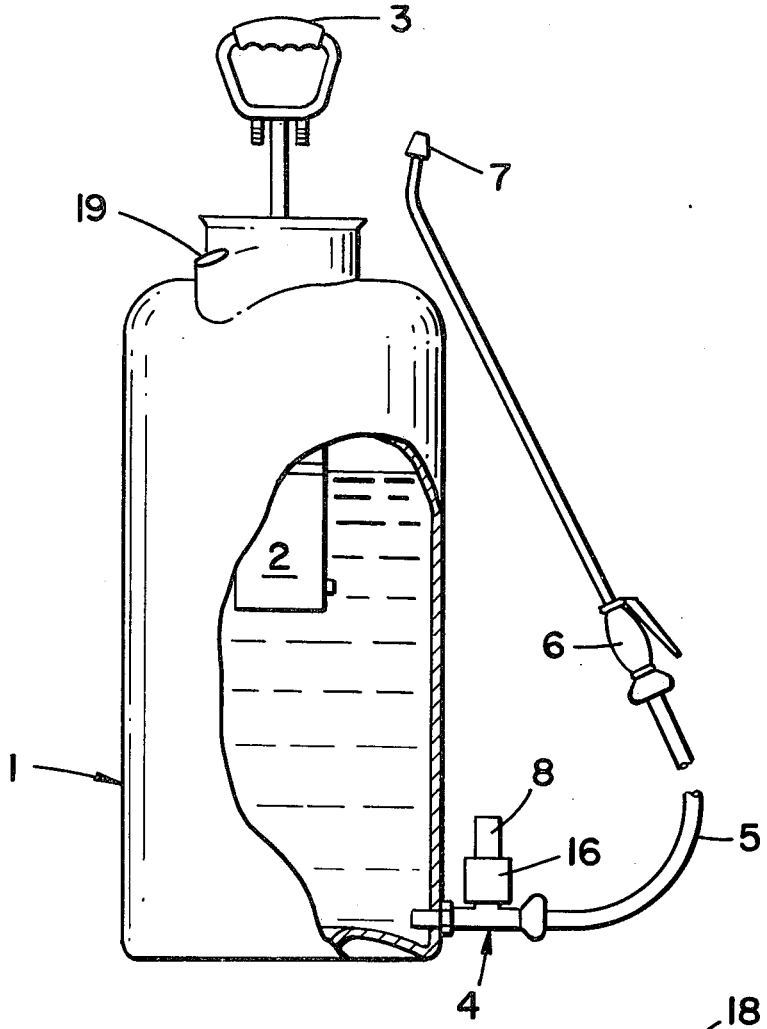
FIG. 1. is a side view, partly in vertical section, of one form of the apparatus of this invention.
Figure 2:
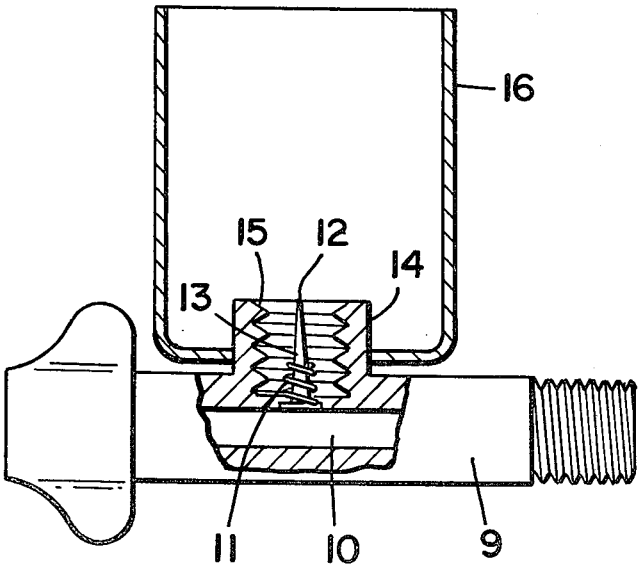
FIG. 2. is a side view, partly in vertical section, of the charging valve present in the apparatus of FIG. 1.
Figure 3:
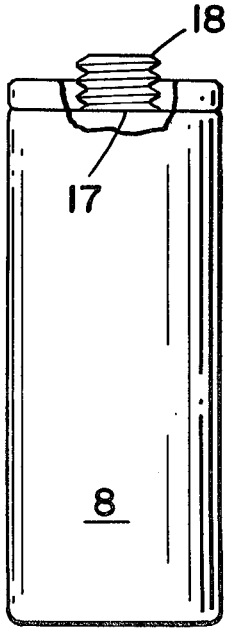
FIG. 3. is a view of the pressurised container adapted for use in the invention.

In the operation of the spraying method of this invention, the spray tank 1 is filled with an amount of water corresponding to the volume of spray liquid which is required. A container 8 holding a formulation of the appropriate active ingredient is inserted into container guide 16 and the container thread 18 engaged with the valve housing extension thread 15. The container is then rotated so as to screw container 8 further into guide 16, thereby causing needle 12 to penetrate into seal 17. As the container thread 18 is screwed further down into housing extension thread 15, the needle 12 continues to penetrate more deeply into seal 17 until the needle hole 13 becomes exposed to the interior of the container. The pressurised contents of container 8 are then forced by the pressure within the container through hole 13, into the hollow needle 12, force open the non-return valve 11 and pass into passage 10 of charging valve 4.

Since the spray valve 6 is in the closed position, the pressure released by the opening of seal 17 forces the contents of container 8 into the water present in spray tank 1, thereby causing simultaneous mixing of the said contents with the water and pressurisation of the resultant spray mixture. If the pressure thus generated is insufficient to provide the necessary spraying pressure (as measured by pressure gauge 19) the necessary additional pressure is produced through pressurising pump 2 by the action of pump handle 3. The apparatus at this stage comprises a spray tank 1 containing the desired spray mixture under an appropriate pressure, and spraying of the locus to be treated is effected simply by opening spray valve 6, when the pressure in spray tank 1 forces the spray mixture contained therein out through spray nozzle 7.

I claim:

1. A spraying device for safe application of agrochemicals comprising a spray tank connected through a spray valve to at least one spray nozzle, the spray tank communicating with a charging valve which incorporates container puncturing means and container attachment means, a container containing an agrochemical formulation under super-atmospheric pressure, and a sealing means located so as to provide a substantially fluid-tight seal between the container for agrochemicals and the charging valve.

2. A device as claimed in claim 1, wherein the puncturing means comprises a sharp projection located in the charging valve so as to impinge upon a weak-point in the container when the two are brought into contact.

3. A method of safely applying an agrochemical formulation to a locus, which comprises loading water into a spray tank connected through a spray valve to at least one spray nozzle and communicating with a charging valve which incorporates puncturing means, attaching to the charging valve a container containing a chemical formulation under super-atmospheric pressure, puncturing the container with the puncturing means, permitting the formulation to flow from the container into the spray tank under the action of pressure whilst maintaining a substantially fluid-tight seal between the container and the charging valve, whereby the formulation is mixed with the water whilst the escape of formulation to the atmosphere is minimized or prevented, and releasing the spray valve to feed the resultant aqueous chemical mixture from the spray tank through the spray nozzles as a spray which is distributed over the locus.

4. A method as claimed in claim 3, wherein the opening of the container is achieved by the provision of a weak point in the container which is easily penetrated by the puncturing means located in the charging valve.

* * * * *